United States Patent [19]

McNamara et al.

[11] 4,047,639

[45] Sept. 13, 1977

[54] ABRASIVE SLURRY REGULATOR ASSEMBLY

[75] Inventors: David M. McNamara, Arlington Heights; Stephen A. Boettcher, Deerfield, both of Ill.

[73] Assignee: Speedfam Corporation, Des Plaines, Ill.

[21] Appl. No.: 716,548

[22] Filed: Aug. 23, 1976

Related U.S. Application Data

[62] Division of Ser. No. 520,608, Nov. 4, 1974, Pat. No. 3,991,918.

[51] Int. Cl.[2] ..... B67D 3/00

[52] U.S. Cl. ..... 222/64; 222/318; 222/527

[58] Field of Search ..... 222/64, 160, 163, 526, 222/527, 533, 478, 481, 482, 484, 485, 318, 356–358; 184/103 R

[56] References Cited

U.S. PATENT DOCUMENTS

| | | | |
|---|---|---|---|
| 1,050,339 | 1/1913 | Cassidy | 222/356 |
| 2,586,104 | 2/1952 | Smyser | 184/103 R |

*Primary Examiner*—Stanley H. Tollberg

*Attorney, Agent, or Firm*—Johnson, Dienner, Emrich & Wagner

[57] ABSTRACT

The regulator assembly comprises body member carried by a support and defining a cavity for detaining a pool of abrasive slurry. An overflow device is associated with the body member for establishing the upper level of a pool of abrasive slurry in the cavity. At least one flow-restrictive conduit component is secured at one end to the body member, communicates with the cavity at the lower end of the pool of abrasive slurry, and presents an outer end from which abrasive slurry is discharged. One of the above-indicated elements is movable whereby to selectively adjust the vertical distance between the plane of the upper level of the pool of abrasive slurry and the plane of the outer end of the conduit component.

5 Claims, 4 Drawing Figures

10
12
14
16
18
20
22
24
26
28
30
32

74
76
78
80
82
84
86
88
90
92
94
96
98
99
100
102
104
h 12
34
36
38
40
42
44
46
48
50
52
54
56
58
60
62
64
66
68
70
72
h 106
108
110
112
114
116
118
120
122
124
126
128
130
132
134
136
138
140
142
143
144
146
148
h

ABRASIVE SLURRY REGULATOR ASSEMBLY

The present application is a division of co-pending application Ser. No. 520,608, filed Nov. 4, 1974, now issued as U.S. Letters Pat. No. 3,991,918.

BACKGROUND OF THE INVENTION

Conventionally, a freely flowing abrasive slurry is fed to the lapping disc of a lapping machine or the like. The abrasive slurry is usually circulated by means of a pump a delivered to the lapping disc through flow-restrictive discharge tubes or conduit means. Heretofore, it has been extremely difficult to maintain a constant discharge rate of abrasive slurry because of variations in pressure and flow of the pump, and it has also been difficult to adjust conveniently the discharge rate for different operating conditions, because of the perverse nature of various slurries.

SUMMARY OF THE INVENTION

In accordance with the present invention, the flow-restrictive discharge tubes are incorporated in a regulator assembly. The abrasive slurry received from the pump by the regulator assembly is detained in a pool at a given level established by overflow means, and the flow-restrictive discharge tubes convey the abrasive slurry from the lower end of the pool to the lapping disc.

By reason of the detention pool of abrasive slurry, the regulator assembly maintains a constant fluid head, and hence provides a constant discharge rate of abrasive slurry, irrespective of variations in pressure and flow of the pump.

Also, in the regulator assembly of the present invention, the fluid head is selectively adjustable for conveniently adjusting the discharge rate of the abrasive slurry whereby to accommodate differing operational requirements of the lapping machine. Depending upon the particular embodiment of regulator assembly, the fluid head is adjusted either by varying the level of the pool of abrasive slurry or by varying the level of the outer ends of the discharge tubes.

DESCRIPTION OF THE PREFERRED EMBODIMENTS

Figure 1:
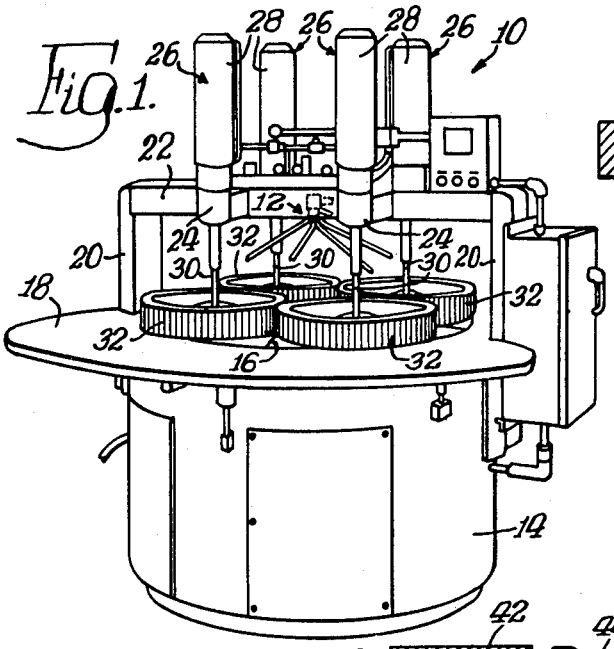
FIG. 1 is an elevational view of a lapping machine incorporating an abrasive slurry regulator assembly of the present invention.

Referring now to FIG. 1, there is indicated generally by the reference numeral 10 a typical lapping machine with which is incorporated an abrasive slurry regulator assembly 12 embodying the principles of the present invention.

The lapping machine 10 comprises a framework including a tubular base or housing 14 which provides support for a horizontal annular lapping disc 16 and a staging table 18 surrounding the lapping disc. Selective rotation of the lapping disc 16 about a vertical axis is effected by suitable drive means (not shown) mounted within the housing 14. Suitably secured to the opposite sides of the housing 14 are lower ends of vertical columns 20. Extending between the upper ends of the columns 20, above the lapping disc 16, is a horizontal bridge member 22 provided with lateral arms 24 which number four in the particular lapping machine herein disclosed. Mounted at the outer ends of each of the lateral arms 24 is a vertical pneumatic piston and cylinder assembly 26. Each of the pneumatic assemblies 26 includes a cylinder 28 and a piston rod 30. The lower ends of the piston rods 30 are secured to horizontal pressure plates (not shown) which fit, with slight clearance, within truing and retaining rings 32 engageable with the lapping disc 16.

When the lapping disc 16 is rotated, the truing rings 32 rotate relative to the pressure plates about the axes defined by the piston rods 30 whereby to dress the lapping disc 16 for maintenance of its planar condition. When work pieces (not shown) are confined within the truing rings 32 below the pressure plates therein, and the lapping disc 16 is rotated, a freely flowing abrasive slurry--that is, a mixture of abrasive particles and an oil or other fluid carrier--is fed by the regulator assembly 12 to the lapping disc 16.

Figure 2:
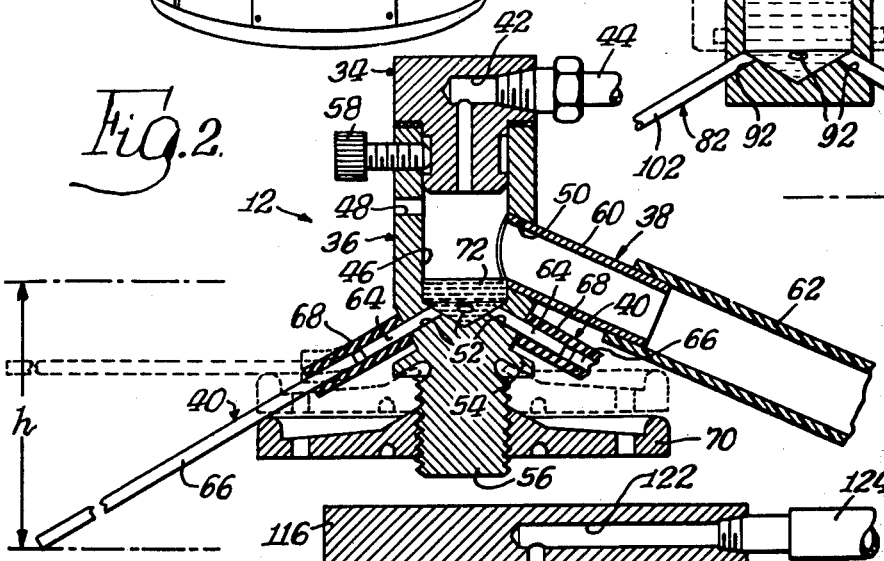
FIG. 2 is a vertical median sectional view, on an enlarged scale, of one embodiment of abrasive slurry regulator assembly of the present invention.

As shown in FIG. 2, the regulator assembly 12 comprises a support or mounting flange 34, body means 36, overflow means 38, and flow-restrictive conduit means 40 which correspond in number to the number of truing rings 32. The support 34 is suitably secured to the lapping machine bridge member 22, and is provided with inlet passageway means 42 connected by tubing 44 to a suitable source of abrasive slurry under pressure. The body means 36 is formed with a central axial bore defining a cavity or chamber 46, an aperture 48 venting the cavity 46 to atmosphere, an overflow opening 50, a plurality of circumferentially spaced apart discharge apertures 52, an annular drip collar portion 54, and a lower threaded end section 56. The body means 36 is secured to the support 34 by a set screw 58. The overflow means 38 includes a sleeve member 60 suitably secured in the overflow opening 50, and tubing 62 connected between the sleeve member 60 ad the source of abrasive slurry under pressure for the return and recirculation of the abrasive slurry. Each of the conduit means 40 includes an inner tube section 64 secured in one of the discharge apertures 52, an outer section 66 presenting an outer end overlying the space between an adjacent pair of the truing rings 32, and an intermediate flexible tube section 68 flexibly interconnecting the inner and outer tube sections 64 and 66. A selectively adjustable hand wheel 70 is threaded on the threaded end section 56 and at its outer periphery has engagement with the outer tube sections 66 of the several conduit means 40 for vertically angularly positioning the tube sections 66. Rotation of the hand wheel 70 between the solid- and dotted-line positions effects vertical angular movement of the outer tube sections 66 between the solid- and dotted-line positions.

In the operation of the regulator assembly 12, abrasive slurry is introduced through the inlet passageway means 42 into the cavity 46 where a pool of abrasive slurry 72 is detained. The lower inner edge of the sleeve member 60, which serves as a weir, establishes the upper level of the pool of abrasive slurry 72 in the cavity 46. This level remains substantially constant regardless of the amount of abrasive slurry introduced into the cavity 46; excess abrasive slurry flows into the overflow means 38. The conduit means 40 serve to convey abrasive slurry from the lower end of the pool of abrasive slurry 72 and to discharge the same from the outer ends of the outer tube sections 66 to the spaces between the adjacent pairs of the truing rings 32.

The rate at which abrasive slurry is discharged from the conduit means 40 is a function of the viscosity and specific gravity of the abrasive slurry, of the composite flow resistance of the conduit means 40, and of the fluid head of the abrasive slurry. The flow resistance of each conduit means 40, in turn, is a function of the inner diameter and length thereof. The fluid head of the abrasive slurry is equal to the vertical distance "*h*" between the plane of the upper level of the pool of abrasive slurry 72 and the plane of the outer ends of the outer tube section 66 of the conduit means 40. For a given fluid head and conduit means 40 of a given size, the discharge rate of abrasive slurry will stabilize at a point where the flow resistance and the fluid pressure at the outer ends of the outer tube sections 66 are equal. For any number of conduit means 40 of equal size, the discharge rate from each is substantially identical. The discharge rate of the abrasive slurry may be regulated by rotating the hand wheel 70 which alters not only the inclinations of the outer tube sections 66 but also the fluid head of the abrasive slurry (the distance of the outer ends of the tube sections 66 below the upper level of the pool of abrasive slurry 72). Because the inclinations of the several tube sections 66 are adjusted simultaneously and equally, the change in discharge rate from each conduit means 40 is substantially identical.

Figure 3:
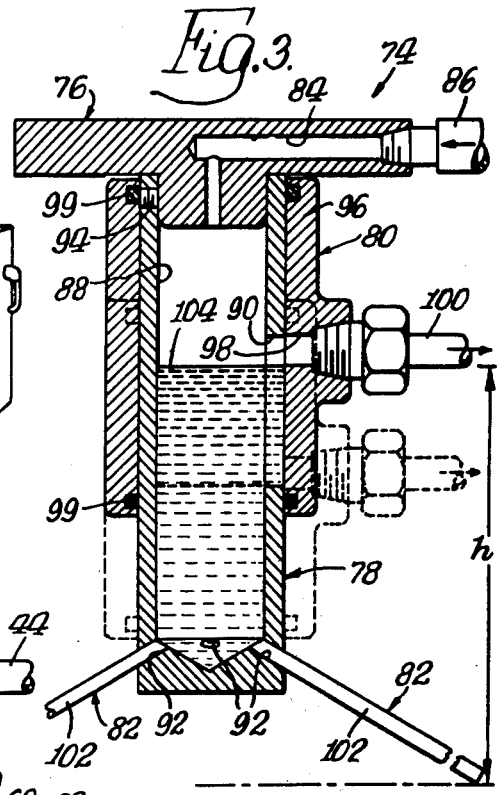
FIG. 3 is a vertical median sectional view of a modified embodiment of abrasive slurry regulator assembly of the present invention.

A modified embodiment of regulator assembly 74 is shown in FIG. 3. The regulator assembly 74 comprises a support or mounting flange 76, body means 78, overflow means 80, and flow-restrictive conduit means 82. The support 76 is adapted to be secured to the lapping machine bridge member 22, and is provided with inlet passageway means 84 adapted to be connected by tubing 86 to a suitable source of abrasive slurry under pressure. The body means 78 is formed with a central axial bore defining a cavity or chamber 88, a vertical elongated opening 90 in the side thereof, and a plurality of bottom circumferentially spaced apart discharge apertures 92. The body means 78 is secured to the support 76 by a set screw 94. The overflow means 80 includes a sleeve member 96 which is vertically slidably mounted on the body means 78 and which is formed with an aperture 98 aligned with and vertically positionable along the elongated body opening 90. Seal means between the sleeve member 96 and the body means 78 are provided by O-rings 99. The sleeve aperture 98 is adapted to be connected by tubing 100 to the source of abrasive slurry under pressure for the return and recirculation of the abrasive slurry. Each of the conduit means 82 is in the form of a tube 102, the upper inner end of which is secured in one of the discharge apertures 92 and the lower outer end of which is adapted to overlie the space between an adjacent pair of the truing rings 32.

In the operation of the regulator assembly 74, abrasive slurry is introduced through the inlet passageway means 84 into the cavity 88 where a pool of abrasive slurry 104 is detained. The lower edge of the sleeve aperture 98, which serves as a weir, establishes the upper level of the pool of abrasive slurry 104 in the cavity 88. For a given position of the sleeve member 96, this level remains substantially constant; excess abrasive slurry flows through the aperture 98 into the tubing 100. The conduit means 82 are adapted to convey abrasive slurry from the lower end of the pool of abrasive slurry 104 and to discharge the same from the outer ends of the tubes 102 to the spaces between the adjacent pairs of the truing rings 32.

The fluid head of the abrasive slurry is equal to the vertical distance "*h*" between the plane of the upper level of the pool of abrasive slurry 104 and the plane of the outer ends of the tubes 102. To regulate the discharge rate of the abrasive slurry, the sleeve member 96 may be vertically moved between the solid- and dotted-line positions whereby the sleeve aperture 98 and the upper level of the pool of abrasive slurry 104 are selectively adjusted thereby altering the fluid head of the abrasive slurry (the distance of the upper level of the pool of abrasive slurry 104 above the outer ends of the tubes 102). In other functional respects, the regulator assembly 74 is substantially identical to the regulator assembly 12.

Figure 4:
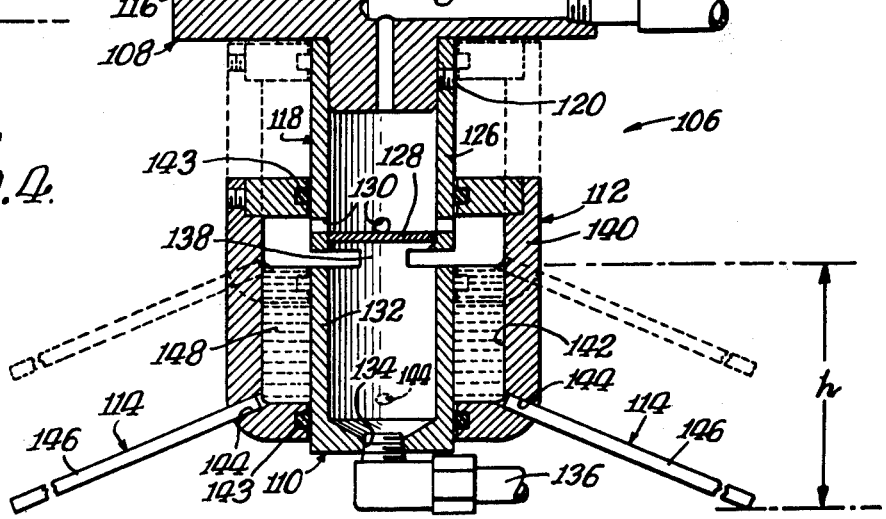
FIG. 4 is a vertical median sectional view of another modified embodiment of regulator assembly of the present invention.

Another modified embodiment of regulator assembly 106 is shown in FIG. 4. The regulator assembly 106 comprises a support 108, overflow means 110, body means 112, and flow restrictive conduit means 114. The support 108 includes a mounting flange 116 and a depending distributor 118 secured thereto by a set screw 120. The mounting flange 116 is adapted to be secured to the lapping machine bridge member 22, and is provided with inlet passageway means 122 connected by tubing 124 to a suitable source of abrasive slurry under pressure. The distributor 118 comprises a sleeve section 126 provided with a bottom closure disc 128 and formed with a plurality of radial ports 130. The overflow means 110 includes an overflow receptacle 132 having a bottom opening 134 connected by tubing 136 to the source of abrasive slurry under pressure of the return and recirculation of the abrasive slurry. The receptacle 132 is secured to or suspended below the sleeve section 126 by connecting portions 138. If desired, the sleeve section 126 and the receptacle 132 may be fabricated from a single tubular member by forming partial cutouts in the side thereof. The body means 112 includes an annular casing 140 which is vertically slidably mounted on the sleeve section 126 and the receptacle 132, which defines with the receptacle 132 an annular cavity or chamber 142. Seal means between the casing 140 and the sleeve section 126 and receptacle 132 are provided by O-rings 143. A plurality of bottom circumferentially spaced apart discharge apertures 144 are formed in the body of the casing 140. Each of the conduit means 114 is in the form of a tube 146 the upper end of which is secured in one of the discharge apertures 144 and the lower outer end of which is adapted to overlie the space between an adjacent pair of the truing rings 32.

In the operation of the regulator assembly 106, abrasive slurry is introduced through the inlet passageway means 122 into the distributor 118 from which it flows through the ports 130 into the cavity 142 where a pool of abrasive slurry 148 is detained. The upper edge of the receptacle 132, which serves as a weir, establishes the upper level of the pool of abrasive slurry 148 in the cavity 142. This level remains substantially constant; excess abrasive slurry flows into the overflow receptacle 132. Th conduit means 114 are adapted to convey abrasive slurry from the lower end of the pool of abrasive slurry 148 and to discharge the same from the outer ends of the tubes 146 to the spaces between the adjacent pairs of the truing rings 32.

The fluid head of the abrasive slurry is equal to the vertical distance "*h*" between the plane of the upper level of the pool of abrasive slurry 148 and the plane of the outer ends of the tubes 146. To regulate the discharge rate of the abrasive slurry, the casing 140 may be vertically moved between the solid- and dotted-line positions whereby the depth of the pool of abrasive slurry 148 and the vertical positions of the outer ends of the tubes 146 are selectively adjusted thereby altering the fluid head of the abrasive slurry (the distance of the outer ends of the tubes 146 below the upper level of the pool of abrasive slurry 148). In other functional respects, the regulator assembly 106 is substantially identical to the regulator assembly 12.

While there have been shown and described preferred embodiments of the present invention, it will be understood by those skilled in the art that various rearrangements and modifications may be made therein without departing from the spirit and scope of the invention.

The invention claimed is:

1. A regulator assembly for controlling the flow of an abrasive slurry, comprising a support, body means secured to said support and defining a cavity containing a pool of abrasive slurry therein and having a vertical elongated opening in the side thereof, overflow means secured to the side of said body means for establishing the upper level of a pool of abrasive slurry in said cavity, said overflow means including an overflow receptacle secured to said support, with said body means being vertically slidable on said support and said overflow receptacle whereby the upper level of the pool of abrasive slurry in said cavity may be selectively adjusted, and a least one flow restrictive conduit means secured at one of said body means and communicating with said cavity at the lower end of the pool of abrasive slurry and presenting an outer end from which abrasive slurry is discharged, and one of said means being movable whereby to selectively adjust the vertical distance between the plane of the upper level in the pool of abrasive slurry and the plane of the outer end of said conduit means.

2. The regulator assembly of claim 1 wherein said support includes a distributor from which abrasive slurry flows into said overflow means includes a receptacle which is suspended below said distributor and which receives overflow abrasive slurry from said cavity, said body means includes a casing mounted on said distributor and said receptacle and defining with said receptacle said cavity, and said casing is vertically movable whereby the depth of the pool of abrasive slurry and the vertical position of said outer end of said conduit means may be selectively adjusted.

3. The regulator assembly of claim 2 including a plurality of circumferentially spaced apart flow-restrictive conduit means.

4. The regulator assembly of claim 2 further including seal means positioned between said distributor and said body means to prevent the loss of abrasive slurry from the regulator assembly.

5. The regulator assembly of claim 1 further including supply means associated with said body means and communicating with said cavity at a point above which said overflow means is secured to said body means for supplying abrasive slurry to said cavity.

* * * * *

UNITED STATES PATENT OFFICE

CERTIFICATE OF CORRECTION

Patent No. 4,047,639 Dated September 13, 1977

Inventor(s) David M. McNamara and Stephen A. Boettcher

It is certified that error appears in the above-identified patent and that said Letters Patent are hereby corrected as shown below:

Col. 6, Line 3, Claim 1

"a" to --at--.

Col. 6, Line 14, Claim 2

"into said overflow" to

--into said cavity, said overflow--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*